United States Patent [19]

Kidder et al.

[11] 3,941,397

[45] Mar. 2, 1976

[54] SKI DEVICE

[76] Inventors: Richard A. Kidder, 406 D. W. Nobel Ave., Santa Ana, Calif. 92707; Henry H. Nakasone, 1672 Camrose Way, Anaheim, Calif. 92802; Bruce D. Jimerson, 2131 Grenadier Drive, San Pedro, Calif. 90732

[22] Filed: June 17, 1974

[21] Appl. No.: 479,665

[52] U.S. Cl. ..... 280/11.35 N; 70/58; 70/312; 224/45 S; 280/11.37 A

[51] Int. Cl.[2] ..... A63C 11/02; A63C 9/00

[58] Field of Search 280/11.37 E, 11.37 K, 11.37 A, 280/11.37 C, 11.37 J, 11.35 N, 11.37 R; 70/58, 57, 312; 211/60 SK; 224/455, 52

[56] References Cited

UNITED STATES PATENTS

| | | | |
|---|---|---|---|
| 1,672,425 | 6/1928 | Rouanet | 70/312 |
| 1,966,334 | 7/1934 | Cruse | 70/312 |
| 2,490,183 | 12/1949 | Wheeler | 280/11.37 E |
| 2,950,119 | 8/1960 | Gembruch | 280/11.35 T |
| 3,481,617 | 12/1969 | Salomon | 280/11.37 A |
| 3,565,450 | 2/1971 | Rosenthal | 280/11.35 N |
| 3,714,803 | 2/1973 | Chenenko | 280/11.37 K |
| 3,715,126 | 2/1973 | Schwarz | 280/11.13 B |
| 3,741,575 | 6/1973 | Bortoli | 280/11.13 B |
| 3,826,510 | 7/1974 | Halter | 280/11.35 N |

FOREIGN PATENTS OR APPLICATIONS

| | | | |
|---|---|---|---|
| 81,402 | 9/1934 | Sweden | 280/11.37 A |

*Primary Examiner*—Robert R. Song
*Assistant Examiner*—Milton L. Smith

[57] ABSTRACT

An apparatus which can be attached to a ski to fulfill three basic functions, namely: 1) as an tote for carrying the skis, 2) as a safety strap to prevent ski runaway, and 3) as a self contained lock. In addition the specification discloses a number of unique features which relate to locks, springs and ski bindings generally.

16 Claims, 17 Drawing Figures

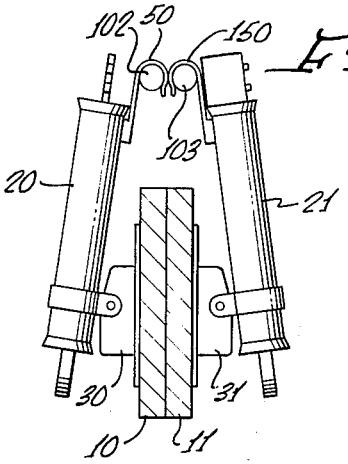
FIG. 8.
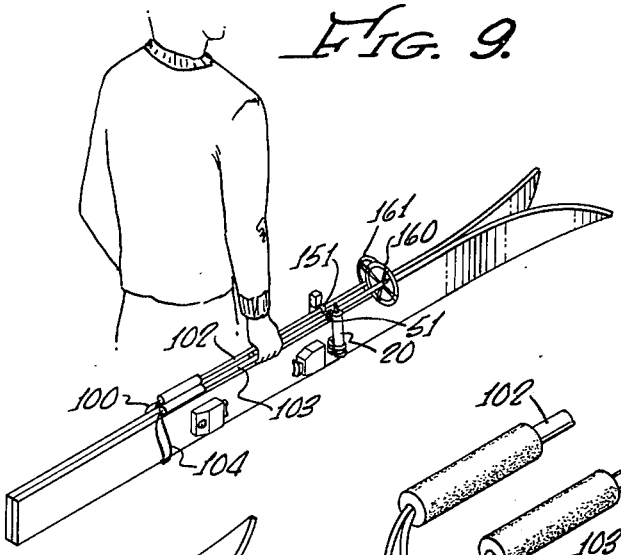
FIG. 9.
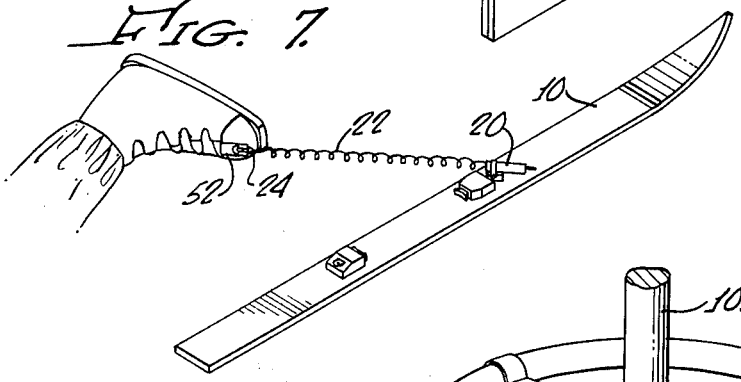
FIG. 7.
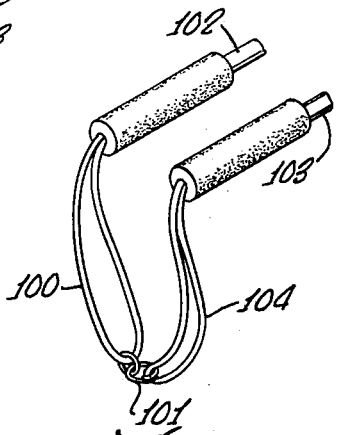
FIG. 10.
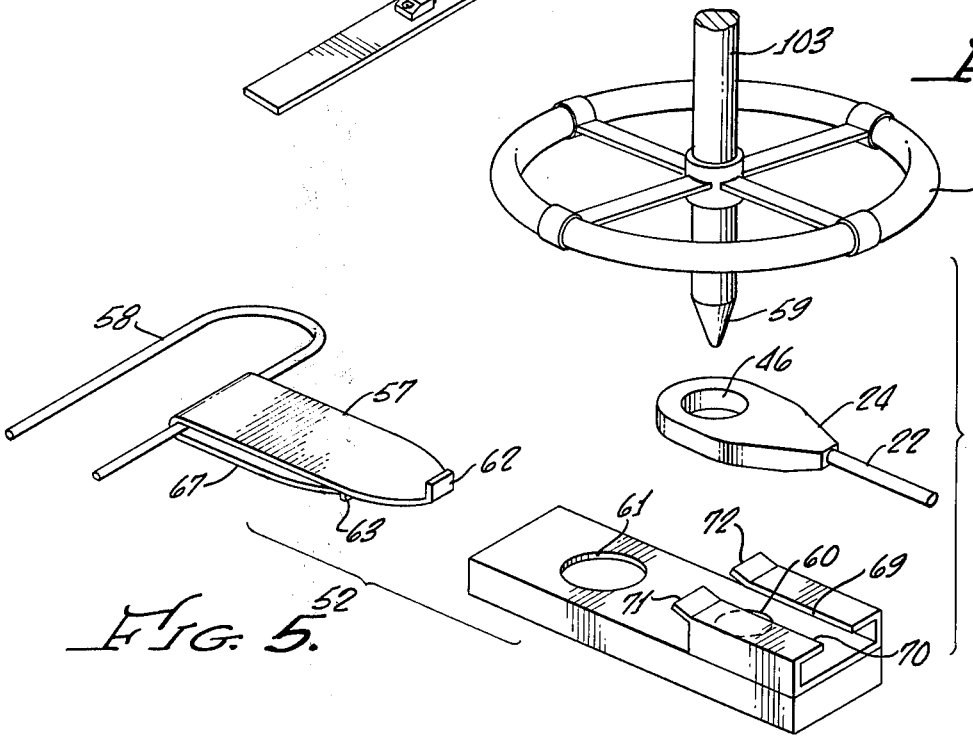
FIG. 5.
FIG. 6.
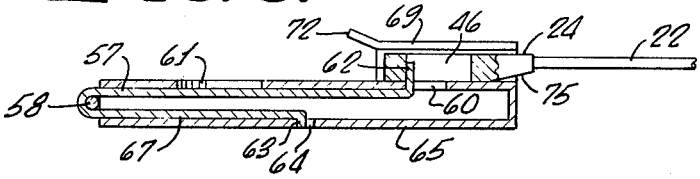

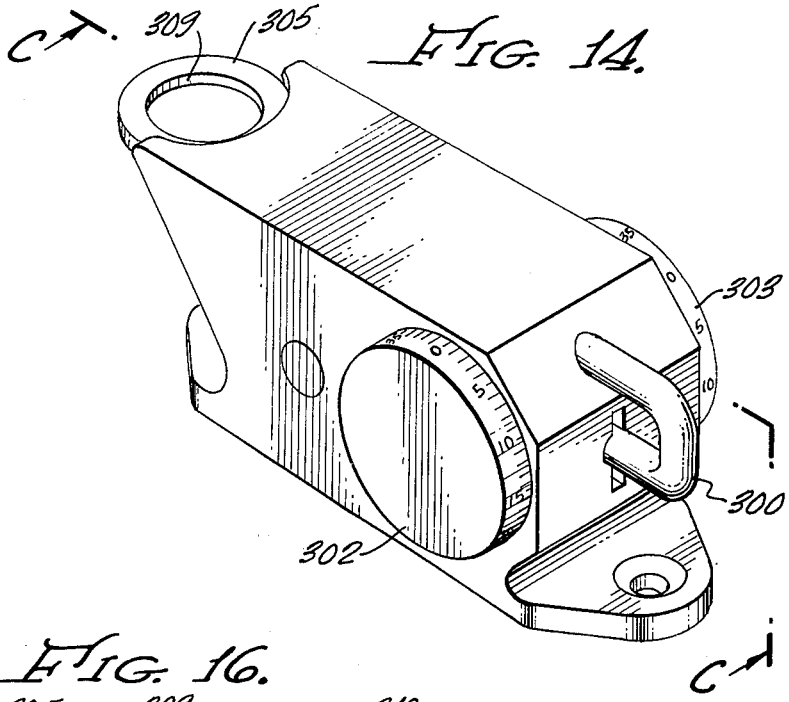
FIG. 14.
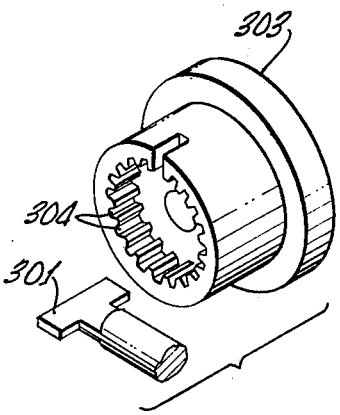
FIG. 15.
FIG. 16.
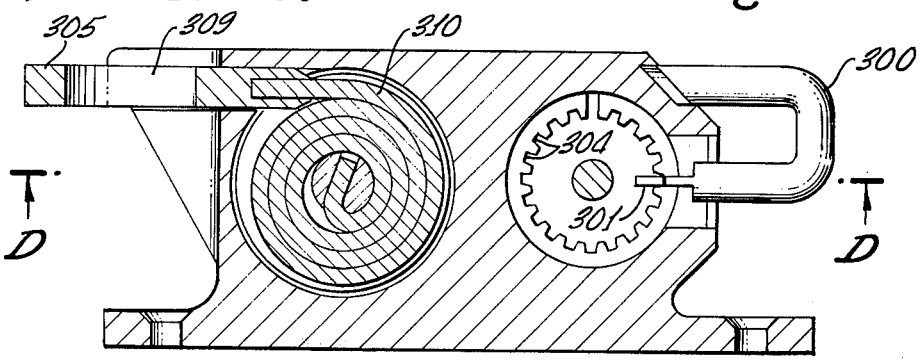
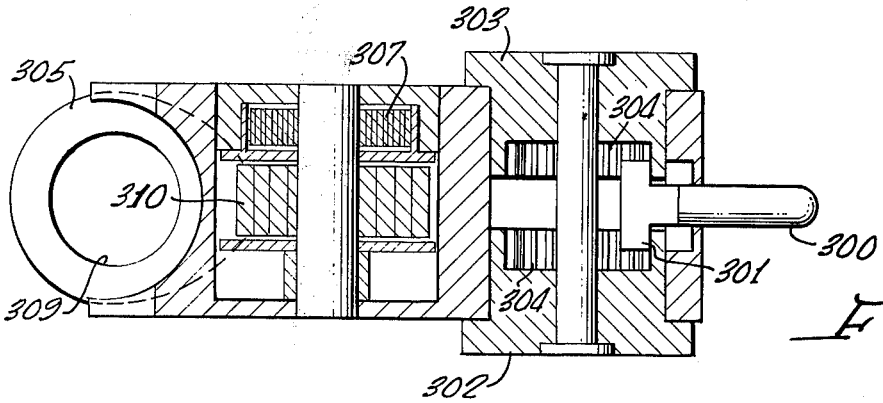
FIG. 17.

SKI DEVICE

BACKGROUND OF THE INVENTION

The ever increasing popularity of skiing has led to a rapid increase in the number of inventions which relate to this sport, particularly with regard to the construction of skis, bindings and locks. For the purposes of background information, reference is made to the following prior art patents.

| Title | Inventor | No. | Date |
|---|---|---|---|
| Ski Lock | N. Chenecko | 3,714,803 | Feb. 6, 1973 |
| Automatic Brake for Skis | E. Bortoli | 3,741,575 | June 26, 1973 |
| Device for Catching a Runaway Ski | G. Schwarz | 3,715,126 | Feb. 6, 1973 |

The primary object of the present invention is to provide an apparatus which can be attached to the skis — which will serve as a safety strap, lock and carrier. It is a further requirement that the device be small, lightweight, and that the weight added to each ski be approximately equal. In addition, it is desirable to have a safety strap arrangement which can be easily attached and detached without bending over. Other objects and advantages of the present invention will be gleaned from the summry and the detailed description of a preferred embodiment given herein below.

SUMMARY OF THE INVENTION

The aforementioned objects of the present invention are realized by the preferred embodiment of the invention which comprises a safety clip receiver adapted to attach to a ski boot buckle, a snap ring for linking the straps of the ski poles together, and a hollow cylindrical shaped housing which is pivotally mounted to each ski ahead of the front toe piece. Each housing contains a spring wound from a stranded wire cable. One end of each spring cable is connected to a safety clip having an eye adapted to receive the tip of a ski pole. The other end of one cable is attached to the female part of a false slotted multiple dial lock; the corresponding end of the other cable is attached to a split shaft male counterpart. The end of each housing is fitted with a flange having a U-shaped opening for receiving the poles.

The structure offers the following advantages over all known prior art devices.

1. Taken together with the ring and bootcatch, the device performs three distinct functions: locking, carrying and ski runaway prevention.
2. The skier is relieved from having to carry anything in his pockets - everything is attached to the skis, poles and boots
3. The false slotted multiple dial lock cannot be opened without knowledge of the combination. The split shaft allows the lock to be secured irrespective of the position of the dials.
4. The stranded spring cable provides much greater security than that which can be achieved with any cable or chain which is flexible enough to wind on a small mandrel.
5. The skier need not bend down and/or fumble in the snow for the safety strap fastener. He can engage and disengage the safety strap with no more effort than that required to operate a "pole-actuated" step-in binding.
6. The safety strap will extend a considerable distance thus minimizing the possibility of injuries which result when the skis are closely strapped to the boot of the skier.
7. The time required to change functions (lock, carrier or safety strap) is nil.
8. The unit may be sold separately or mounted on an common plate with a replacement toe piece. In such a case, it is contemplated that the front toe piece include a safety toggle to enhance overall sales appeal.

DESCRIPTION OF THE DRAWINGS

FIG. 5 is a perspective view showing the details of the boot catch and safety clip.

FIG. 6 is a cross-section of the boot catch showing the position of the safety clip when it is secured by the boot catch.

FIG. 7 is a perspective view illustrating the action of the cable spring in preventing ski runaway.

FIG. 8 is a cross-section taken through the housing with the housing oriented in the tote position.

FIG. 9 shows a perspective view of skis being carried.

FIG. 10 shows a perspective view of the pole strap linking arrangement.

FIG. 14 shows a perspective view of an alternative embodiment which will accomplish some of the functions of the preferred embodiment.

FIG. 15 shows the false slotted locking arrangement for the embodiment shown in FIG. 14.

FIG. 16 shows a cross-section taken through the plane C—C of FIG. 14.

FIG. 17 shows a cross-section taken through the plane D—D of FIG. 16.

Figure 1:
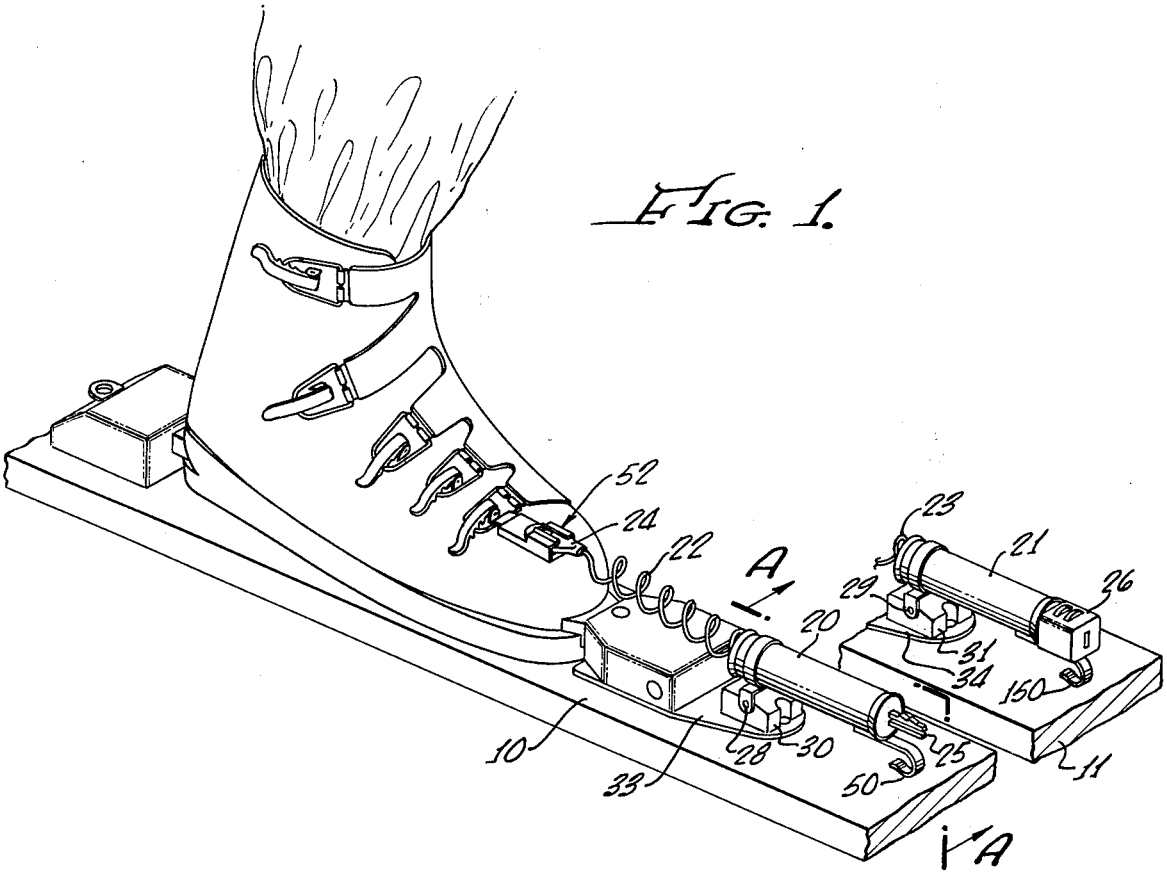
FIG. 1 shows a perspective view of a preferred embodiment of the invention as it would appear when functioning as a safety strap to prevent ski runaway.
Figure 2:
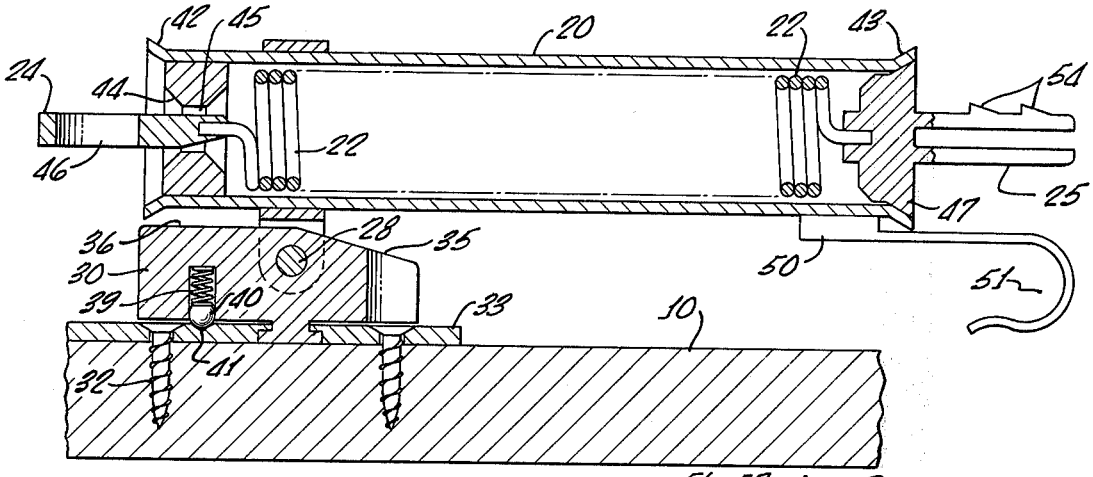
FIG. 2 shows a cross-section taken through the plane A—A illustrating the position of the elements when the safety clip is disengaged from the boot catch.

DETAILED DESCRIPTION OF A PREFERRED EMBODIMENT:

Adverting to the drawings, and particularly FIGS. 1 and 2, a preferred embodiment of the invention comprises a pair of identical cylindrical shaped housings 20 and 21, each containing a spring (22 and 23 respectively), the left end of each being attached to safety clips (e.g. clip 24). The only difference between the device of ski 10 and that on ski 11 is that the right end of spring 23 is attached to the female portion 26 of a multiple dial lock, and the right end of spring 22 is attached to the male counter part 25. Pins 28 and 29 journal housings 20 and 21 to the swivel bases 30 and 31 respectively, the latter being freely rotatable with respect to the plates 33 and 34 which are attached to the skis by screws (as indicated by screws 32 and 37). As best seen in FIG. 2 the front top surface 35 of each swivel base slopes downwardly to permit the housings to tilt forwardly when rotated to the carrying position as explained below - the rear back portion 36 being approximately parallel to the top surface of the skis so as to function as a "stop" to keep the housing approximately parallel to the ski when the invention is functioning as a ski runaway safety device.

The swivel base 30 can be positioned as shown to provide an access to screw 32 (using an L shaped tool) or rotated 180° to access screw 37. The ball detent arrangement (spring 39, ball 40 and base plate recess 41) functions to restrain the orientation of the housing 20 parallel to the ski 10. To orient the housing 20 for locking or carrying (as explained below) it is only necessary to overcome the bias of the detent spring to rotate housing 20 to a right angle position with respect to the ski 10.

Referring specifically to FIG. 2, it will be seen that the housing 20 is flared at each end as indicated by the numerals 42 and 43 in order to facilitate the retraction of the spring 22 into the housing. The left end of the housing 20 is cut to have a wide mouth V-shaped opening as indicated by numeral 44 which funnels the safety clip 24 into the deeper parallel slot 45 where it is held in position by the retracting force of the attached spring 22. The hole 46 in safety clip 24 is located beyond the end of housing 20 so that it can be easily stabbed with the tip of a ski pole. The appendage 50 attached to the right end of housing 20 has a U-shaped recess 51 of a size sufficient to accommodate the diameter of a typical ski pole. It will be understood that the description of the assembly shown in FIG. 2 applies equally to the assembly attached to the left ski 11 — the only difference being that the right end of the spring 23 attaches to the female portion 26 of the lock rather than the male 25. In each case however, a tapered guide disk (i.e. disc 47) is used to facilitate an accordant, guided slip fit between the lock (25 or 26) and the flared right end of the housing (20 or 21).

An important advantage of the coiled spring arrangement (springs 22 and 23) over prior art cable wind up devices, lies in the fact that even a strong heavy spring will self retract to occupy a very small space. For best results however, the springs 22 and 23 should have a low spring constant to facilitate easy withdrawal (particularly when the ski pole is used to pull the clips backward to engage the boot catch), and yet be of sufficient diameter to discourage tampering when the cables are used to effectuate locking. A further requirement is that the springs not be permanently stretched (plastically deformed) by the acceleration forces which occur when the runaway ski is abruptly stopped as the spring approaches the limit of its extension. It was discovered that springs wound from stranded wire cables had ideal characteristics. Experiments were carried out using stainless steel cables such as 1/6 dia. 7 × 7, and ⅛ dia. 7 × 19. The springs were highly of extension — yet very little plastic deformation resulted when much larger forces were applied. For minimization of plastic deformation, some (or all) of the individual strands could be spring steel rather than stainless or galvanized.

A common shortcoming of most multiple dial locks lies in the fact that the projections on the male shaft are not precisely spaced with respect to the dials of the female part of the lock. As a consequence, the combination can be discovered by rotating the dials while applying a slight opening force to withdraw the shaft. By turning the dial which is hardest to rotate, one can discover where the dial slot lines-up with the corresponding projection on the male shaft. When this position is reached the male shaft will slip forwardly slightly so that another dial will be in contact with a different projection, and so on — until each dial slot has been aligned with the shaft projections — thus enabling the lock to be opened.

Figure 3:
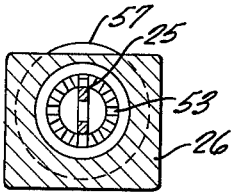
FIG. 3 is a cross-sectional view taken through the plane B—B of the female portion of the lock showing the false slotted dials.
Figure 4:
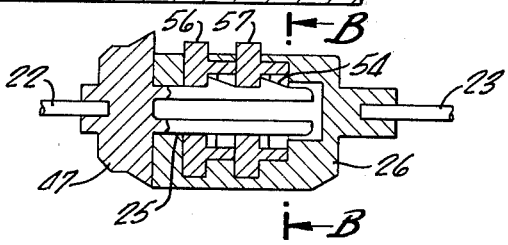
FIG. 4 is a cross-section of the lock as it would appear in the locked position.

FIGS. 3 and 4 show the details of the locking device which comprises a portion of the present invention. Each wheel is fabricated so as to have a plurality of false slots into which the projections 54 on the shaft 25 will enter when a force is applied to pull the male 25 and female 26 parts apart. As a consequence, one cannot rotate either dial 56 or 57 while applying a separating force. It is therefore impossible to discover the combination by the aforementioned means. A second novel feature of the lock lies in the use of a split shaft 25 which allows the user to close the lock irrespective of the dial position, i.e., it is not necessary to set the combination in order to insert the shaft 25.

Figure 12:
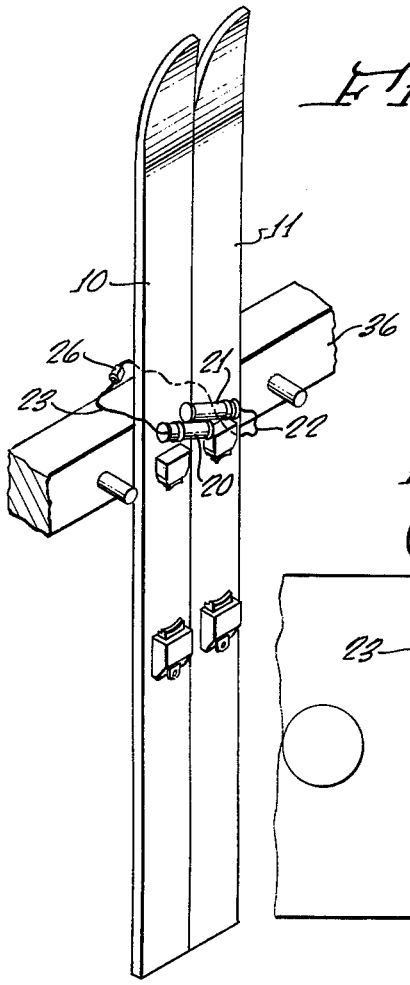
FIG. 12 shows the skis and poles as they would appear when secured to a conventional ski rack.
Figure 11:
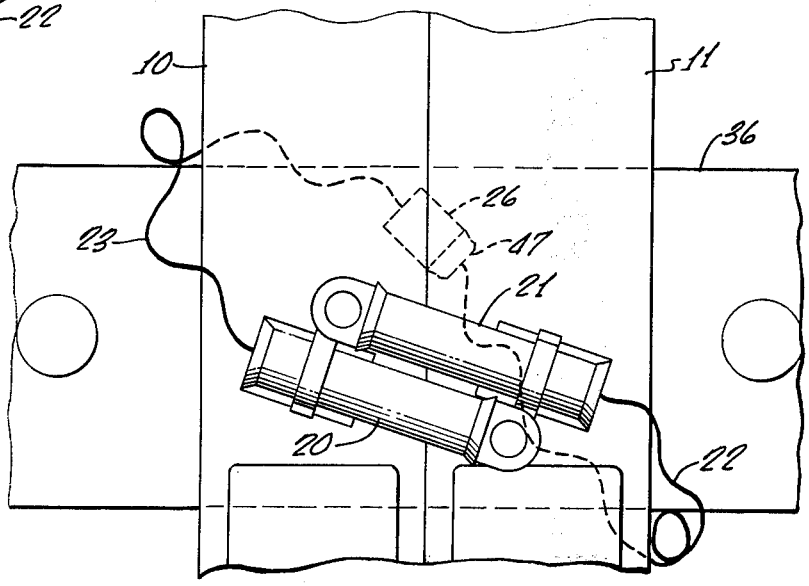
FIG. 11 is a perspective closeup of the locking arrangement.

FIGS. 11 and 12 show the operation of the invention as a lock to secure a pair of skis to a conventional ski rack. The cables 22 and 23 are extended from their respective housings 20 and 21 pulling the male and female portions of the lock 25 and 26 outwardly so that each cable crosses over the opposite ski, with one cable 23 passing over the top of the ski rack 56 and the other cable 22 passing under the ski rack 56 to a point behind the rack where the male and female portions 25 and 26 can be brought together as shown. Although not necessary for security, FIG. 11 shows the housings 20 and 21 rotated (via their respective swivel bases 30 and 31) so as to be at 80° angles with respect to the skis 10 and 11. In FIG. 12, the skis are placed parallel. They could also be positioned and secured so that the bottom surfaces are together — with the cables passing through the pole straps thus securing both skis and poles.

FIGS. 5 and 6 show the details of the boot catch assembly 52 and how it functions to retain the safety clip. The leaves 57 and 67 of the boot catch spring are normally sprung slightly apart so that the projections 63 and 62 will snap into the openings 64 and 60 of the boot catch guide 65 thus securing the entire assembly to the boot buckle 58. In order to attach the safety strap, the skier stabs through the hole 46 in clip 24 with the ski pole 59 — and draws the clip 24 backward until the pole tip 59 is positioned above the hole 61 with cable 22 lying between the guides 69 and 70. When the pole is lifted, the clip 24 will be slid free of the pole tip 59 by the bent guide extensions 71 and 72. The coil spring 22 draws the clip 24 forward between the guides 69 and 70, the sloping under lip 75 of the clip riding over the projection 62, until the hole 46 is reached. At this point, the spring bias on upper leaf 57 causes projection 62 to enter the hole 46, thus securing the clip 24 in the boot catch 52. To release the clip, the skier need only stab with the pole through hole 61 to deflect leaf 57 so as to remove projection 62 from hole 46 thus releasing the clip 24. When this occurs the stretched spring 22 retracts pulling the clip 24 forward between the guides 69 and 70 and free from the boot catch — to the position shown in FIG. 2.

FIG. 7 illustrates the action of the boot catch in preventing ski runaway. Were it not for the boot catch and safety clip, the ski would continue to travel down the hill after the safety binding releases. Because of the low spring constant, cable spring 22 will easily extend to its maximum length of approximately 15 inches thus minimizing the chance of injury which maay occur if the ski is closely fastened to skier as is the case with conventional safety straps. While the ski runaway devices described in the above referenced patents offer a similar advantage, they have a shortcoming in that the completely disattached ski may be hazardous to others — particularly to those skiing directly under the path of the chair lifts.

FIGS. 8, 9 and 10 show the operation of the invention as a ski tote. The only additional element required is a small snap ring 101 which is permanently attached to the strap 100 of one ski pole 102 as shown in FIG. 10. To set up the carrier, the two straps 100 and 104 are first linked together by the snap ring 101. With the skis standing on end, the housings 20 and 21 are then rotated on their respective swivel bases 30 and 31 so as to be perpendicular to the skis 10 and 11 as shown in FIG. 8. The poles 102 and 103 are then placed behind the standing skis and brought forward so that the linked pole straps form a cradle-like suspension for the rear of the skis. The poles are next snapped into the U-shaped recesses 51 and 151 in the housing appendages 50 and 150 just above the baskets 160 and 161. The skis and poles are then brought to the horizontal position shown in FIG. 9 with the poles functioning as the carrying handle.

Figure 13:
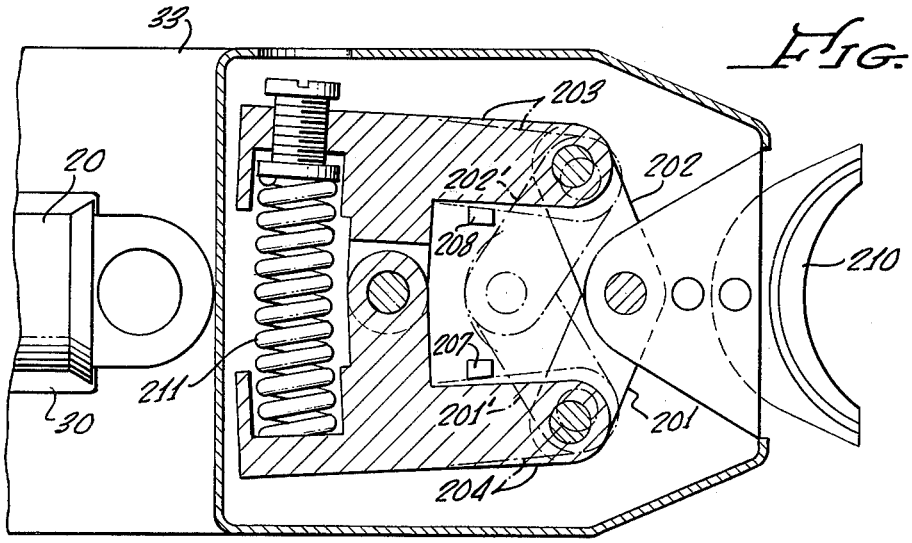
FIG. 13 shows an elevation view of the toggle toe piece mounted on a common base plate with the other elements of the invention.

FIG. 13 shows how the basic invention can be mounted on the same plate and in combination with the toe piece of the boot binding. While it is contemplated that the basic invention will be sold separately as an "add-on" device, it is possible that some manufacturers will wish to utilize a common mounting plate. The toe binding shown in FIG. 13 has particular appeal from the standpoint of safety in that it will snap forward when the force exceeds a pre-established amount. This feature is of considerable importance in preventing injuries which occur before a conventional toe piece can swivel to one side to release the skier. The toggling function is accomplished by the links 201, 202, 203 and 204, the latter being normally biased against the stops 207 and 208 so as to maintain the toe piece 210 in the position shown. When the forward force on the toe piece 210 exceeds the bias force of spring 211, the toe piece is released directly forward, the links 202 and 203 rotating to the position indicated by the dotted lines 202' and 203'. The forward movement of the toe piece relieves the forces on the toe piece 210 which tend to impair swivel — and in addition allows the rear of the boot to pop free of the rear binding.

FIGS. 14–17 show an alternative embodiment of the basic invention which will accomplish some of the functions of the preferred embodiment. The locking arrangement utilizes a U-shaped shackle 300 having a T shaped end 301 which is secured by the dials 302 and 303. Both dials are false slotted (304) in a manner analogous to the false slots 53 shown in FIGS. 3 and 4. To lock the device, the safety clip 305 is withdrawn against the force of the spiral negator spring 307 and passed around a post or ski rack and then securely by passing the shackle 300 through the hole 309, each ski being separately locked to the post. The ski runaway feature is the same as that described in connection with the preferred embodiment, the additional elements 52 shown in FIG. 5 being also required for the alternative embodiment.

The device shown in FIGS. 14–17 is not easily adapted to carry the skis. Moreover, in order to maintain a small physical size, the windup cable 310 must have a small diameter (1/16 of an inch or less) in order that it will be flexible enough to wind on a small mandrel.

Although the basic concept of the invention has been shown and described in connection with a preferred embodiment, it will be understood that numerous features may be utilized separately or in combination with other devices — and still be within the spirit of the invention. Moreover, the concepts disclosed in connection with the lock are not limited to ski devices, but are applicable to locking devices generally. Similarly, the basic concept of the toggle toe piece is not limited to use in combination with the preferred embodiment of the invention — but is of equal merit standing alone. Nor are the concepts limited to the particular embodiment shown and described. It will thus be understood that many changes, modifications and substitutions may be made without departing from the spirit of the invention.

We claim:

1. A ski accessory comprising:

a first housing;

means for attaching said first housing to one ski;

a second housing;

means for attaching said second housing to the other ski;

a first elastically retractable member within said first housing;

a second elastically retractable member within said second housing;

runaway ski prevention means for temporarily attaching one end of each said first and second elastically retractable members to the skier so as to prevent ski runaway, said runaway ski prevention means comprising a first safety clip attached to said first elastically retractable member and a second safety clip attached to said second elastically retractable member and a first receiver attached to the skier for retaining said first safety clip and a second receiver attached to the skier for retaining said second safety clip;

means for locking said first and second elastically retractable members together about a ski rack so as to prevent the unauthorized removal of the skis.

2. The apparatus recited in claim 1 wherein is included:

a first flange attached to said first housing;

a second flange attached to said second housing;

said first and second flanges each having a U-shaped recess of a size sufficient to accommodate the diameter of a ski pole;

means for orienting said first and second housings so that one U-shaped recess will engage one ski pole and the other U-shaped recess will engage the other pole when the lengthwise axis of said skis and poles are placed parallel to each other.

3. The apparatus rectied in claim 2 including:

means for temporarily linking the pole straps of a pair of ski poles together whereby the poles may function as a carrying handle with the linked pole straps forming a cradle to support one end of the skis and the U-shaped recesses hooked over the poles to support the other end of the skis.

4. The apparatus recited in claim 1 wherein said first housing comprises a first hollow tube and wherein said second housing comprises a second hollow tube;

and wherein the first and second elastically retractable members comprise:

a first stranded wire spring within said first hollow tube and a second stranded wire spring within said second hollow tube, each of said first and second stranded wire springs having a coil diameter less than the inside diameter of its associated hollow tube and a retracted length less than the length of its associated hollow tube.

5. The apparatus recited in claim 4 wherein one end of said first stranded spring is attached to the female part of a false slotted multiple dial lock and the other end of said first stranded spring is attached to a first safety clip.

6. The apparatus recited in claim 5 wherein one end of said second stranded wire spring is attached to the split shaft male counterpart of said multiple dial lock, and the other end of said second stranded spring is attached to a second safety clip.

7. The apparatus recited in claim 1 wherein each of said first and second safety clips have an eye of sufficient size to accommodate the tip of a ski pole;

and wherein said first clip receiver is adapted to attach to a buckle of a first ski boot, and said first receiver has an opening adapted to receive said first safety clip, and includes a first catch adapted to engage said first safety clip;

and wherein said second clip receiver is adapted to attach to a buckle of a second ski boot, and said second receiver has an opening adapted to receive said second safety clip, and includes a second catch adapted to engage said second safety clip;

means responsive to a force applied by the tip of a ski pole for disengaging said first and second catches so as to release said first and second safety clips from said first and second clip receivers.

8. A ski accessory comprising:

a first housing having a recess of a size sufficient to accommodate the diameter of a ski pole;

swivel means for attaching said first housing to one ski so as to permit said first recess to be positioned to receive a ski pole;

a second housing having a second recess of a size sufficient to accommodate the diameter of a ski pole;

swivel means for attaching said second housing to the other ski so as to permit said second recess to be positioned to receive a ski pole;

means for temporarily linking the pole straps of a ski pole together whereby the poles may be placed parallel to the skis to function as a carrying handle with the linked pole straps forming a cradle to support one end of the skis and the housing recesses hooked over the poles to support the other end of the skis.

9. The apparatus recited in claim 8 wherein said first housing comprises a first hollow tube and wherein said second housing comprises a second hollow tube; and wherein is included:

a first elastically retractable ski runaway prevention means within said first housing;

a second elastically retractable ski runaway prevention means within said second housing.

10. The apparatus recited in claim 9 wherein one end of said first elastically retractable ski runaway prevention means is attached to the female part of a multiple dial lock and the other end of said first elastically retractable ski runaway prevention means is attached to a first safety clip.

11. The apparatus recited in claim 9 wherein said first elastically retractable ski runaway prevention means comprises a stranded wire spring.

12. The apparatus recited in claim 8 wherein said first housing comprises a first hollow tube and wherein said second housing comprises a second hollow tube and wherein is included:

a first elastically retractable member within said first housing and, a second elastically retractable member within said second housing, and including a locking means attached to one end of said first elastically retractable member for locking the ends of said first and second elastically retractable members together.

13. A ski accessory comprising:

a first housing;

means for attaching said first housing to one ski;

a second housing;

means for attaching said second housing to the other ski;

a first elastically retractable member within said first housing;

a second elastically retractable member within said second housing;

a first safety clip attached to one end of said first elastically retractable member, said first safety clip having an opening adapted to receive a ski pole tip;

a second safety clip attached to one end of said second elastically retractable member, said second safety clip having an opening adapted to receive a ski pole tip;

a first receiver adapted to retain said first safety clip;

means for attaching said first receiver to a human being;

a second receiver adapted to retain said second safety clip;

means for attaching said second receiver to a human being;

first release means responsive to a ski pole tip for releasing said first safety clip from said first receiver; and second release means responsive to a ski pole tip for releasing said second safety clip from said second receiver.

14. The apparatus recited in claim 13 including:

a first flange attached to said first housing;

a second flange attached to said second housing;

said first and second flanges each having a U-shaped recess of a size sufficient to accommodate the diameter of a ski pole;

means for orienting said first and second housings so that one U-shaped recess will engage one ski pole and the other U-shaped recess will engage the other pole when said skis and poles are placed to have their lengthwise axis parallel.

15. The apparatus recited in claim 13 including:

means for temporarily linking the pole straps of a pair of ski poles together whereby the poles may function as a carrying handle with the linked pole straps forming a cradle to support one end of the skis and the U-shaped recesses hooked over the poles to support the other end of the skis.

16. The apparatus recited in claim 13 wherein said first housing comprises a first hollow tube and wherein said second housing comprises a second hollow tube;

and wherein said first and second elastically retractable members comprise:

a first stranded wire spring within said first hollow tube and a second stranded wire spring within said second hollow tube, each of said first and second stranded wire springs having a coil diameter less than the inside diameter of its associated hollow tube and a retracted length less than the length of its associated hollow tube.

* * * * *